US009626848B2

(12) United States Patent
Davies

(10) Patent No.: US 9,626,848 B2
(45) Date of Patent: Apr. 18, 2017

(54) SECURITY DEVICE

(71) Applicant: GCS (GB) Limited, Sussex (GB)

(72) Inventor: Jeremy Davies, Sussex (GB)

(73) Assignee: GCS (GB) Limited, Sussex (GB)

( * ) Notice: Subject to any disclaimer, the term of this patent is extended or adjusted under 35 U.S.C. 154(b) by 0 days.

(21) Appl. No.: 14/478,486

(22) Filed: Sep. 5, 2014

(65) Prior Publication Data

US 2015/0061871 A1 Mar. 5, 2015

(30) Foreign Application Priority Data

Sep. 5, 2013 (GB) ..... 1315838.1

(51) Int. Cl.

| | |
|---|---|
| ***G08B 13/14*** | (2006.01) |
| ***G08B 13/06*** | (2006.01) |
| ***C11C 5/00*** | (2006.01) |
| ***E05B 73/00*** | (2006.01) |

(52) U.S. Cl.

CPC ..... *G08B 13/06* (2013.01); *C11C 5/006* (2013.01); *E05B 73/0017* (2013.01); *E05B 73/0041* (2013.01); *G08B 13/14* (2013.01)

(58) Field of Classification Search

CPC G08B 13/2417; G08B 13/2434; G08B 13/06; G08B 13/14; E05B 73/0017; E05B 73/0041; Y10T 70/5004; C11C 5/006

USPC ... 340/572.1, 572.8, 572.9, 571, 693.5, 546; 70/57.1, 58

See application file for complete search history.

(56) References Cited

U.S. PATENT DOCUMENTS

| | | | | |
|---|---|---|---|---|
| 4,744,471 | A | 5/1988 | Leister | |
| 8,400,301 | B1 * | 3/2013 | Kersch | G08B 13/08 340/546 |
| 2002/0130778 | A1 * | 9/2002 | Nicholson | B65D 5/4233 340/572.1 |
| 2007/0261468 | A1 * | 11/2007 | Crespo | G01N 33/4972 73/1.03 |
| 2009/0135015 | A1 * | 5/2009 | Dobson | H04Q 9/00 340/572.9 |
| 2011/0012713 | A1 * | 1/2011 | Wilkinson | G06K 7/10178 340/10.3 |

(Continued)

FOREIGN PATENT DOCUMENTS

| | | | |
|---|---|---|---|
| BR | PI 1103878-0 | A2 | 7/2013 |
| CN | 2496725 | Y | 6/2002 |
| CN | 200945854 | Y | 9/2007 |

(Continued)

OTHER PUBLICATIONS

Patents Act 1977: Search Report under Section 17 for Great Britain Application No. 1315838.1, dated Jan. 16, 2014, 2 pages.

*Primary Examiner* — Thomas Mullen

(74) *Attorney, Agent, or Firm* — Westman, Champlin & Koehler, P.A.

(57) ABSTRACT

There is described a security device for insertion into a container product for protection of the container product. The security device comprises a body portion moveable between a contracted configuration and an expanded configuration; and a locking mechanism operable to lock the body portion in the expanded configuration and operable to unlock the body portion from the expanded configuration; wherein, when the body portion is locked in the expanded configuration, the body portion has a length that cannot be reduced below a predefined length.

17 Claims, 4 Drawing Sheets

(56) References Cited

U.S. PATENT DOCUMENTS

2012/0267436 A1* 10/2012 Yang ..... G08B 13/2434
235/492

FOREIGN PATENT DOCUMENTS

| | | | |
|---|---|---|---|
| CN | 102787767 | A | 11/2012 |
| GB | 2351759 | A | 1/2001 |
| JP | H08326389 | A | 12/1996 |
| TW | 201321931 | A | 6/2013 |

* cited by examiner

SECURITY DEVICE

CROSS-REFERENCE TO RELATED APPLICATION

This Application is a non-provisional Application of Great Britain Application No. GB 1315838.1, filed Sep. 5, 2013, the content of which is hereby incorporated by reference in its entirety.

The invention relates to a security device for protection of a product, a system for security protection and a method of using a security device to protect a product. The invention is particularly useful for protecting container products, such as candle jars.

BACKGROUND

Products to be sold in retail stores may be provided with security devices to prevent stealing, tampering or other actions detrimental to the value or security of the product.

A typical security device well known in the art is attached to an external surface of a product to be protected or a box containing said product by means of an adhesive or other attachment means (e.g. wires from a spool on the device or plastic braces to clip onto the product). However, the attachment of the security device to the product while the product is on display in a retail store may obscure information useful for sales and marketing and/or prevent examination of and interaction with the product by a potential buyer. Furthermore, the attachment of the security device to the product may detract from the aesthetic appeal of the product, thereby possibly deterring potential buyers. Additionally, these external security devices may put the product at risk of damage and/or take up significant display space, thus reducing the number of products able to be on display.

There is a need for a security device which overcomes at least some of the disadvantages associated with those external security devices currently available.

SUMMARY OF THE INVENTION

According to the present invention, there is described a security device for protection of a product, the security device comprising a body portion moveable between a contracted configuration and an expanded configuration and a locking mechanism operable to lock the body portion in the expanded configuration and operable to unlock the body portion from the expanded configuration wherein, when the body portion is locked in the expanded configuration, the body portion has a length that cannot be reduced below a predefined length. By placement of a body portion of a security device inside a product, the product can be protected without the need for external attachment and the associated disadvantages as described above.

Advantageously, when the body portion is locked in the expanded configuration, the length of the body portion is substantially fixed. By having a length that is substantially fixed, there is no possibility of the security device being reduced in size to be removed from the product through the opening.

Advantageously, when the body portion is locked in the expanded configuration, the body portion has a cross-sectional area that cannot be reduced below a predefined area.

Advantageously, when the body portion is locked in the expanded configuration, the body portion has a cross-sectional area that is substantially fixed.

Advantageously, the locking mechanism is operable to unlock the body portion from the expanded configuration by application of a separate key device. Having a separate key device increases security by permitting only those with the necessary key device to unlock the security device.

Advantageously, the security device further comprises one or more of an Electronic Article Surveillance (EAS) tag suitable for tracking the security device, an anti-tamper alarm, a light sensitive alarm, a movement sensitive alarm, and an ink or dye deployment device. These additional features provide extra security to the product.

Advantageously, the body portion is substantially planar in both the contracted configuration and the expanded configuration. By being substantially planar the body portion, once inside the product, can move into the expanded configuration in a narrow space inside the product.

Advantageously, the body portion comprises a first section and a second section, the first and second sections being coupled so as to permit planar movement of the first section relative to the second section.

There is also described, in accordance with the present invention, a system for security protection, the system comprising the security device of the present invention and a product to be protected, the product comprising an opening, wherein, in use when the body portion is in the contracted configuration, the body portion is insertable into the product through the opening; when the body portion is inside the product, the body portion is able to be moved from the contracted configuration to the expanded configuration; and when the body portion is inside the product in the expanded configuration, the locking mechanism is engagable to lock the body portion in the expanded configuration such that the body portion cannot be removed from the product through the opening.

Advantageously, the product is a container comprising the opening, wherein a size of the opening is smaller than a size of the container. Such a size may be a diameter, a perimeter or a cross-sectional area.

Advantageously, the container contains a candle having a wick accessible through the opening. This type of product is ideally suited for protection by the security device of the present invention, as attachment of an external security device is particularly undesirable because the aesthetic appearance of the product is important in attracting potential customers.

Advantageously, in use, when the body portion is inside the container and locked in the expanded configuration, the body portion prevents access to the wick through the opening. Therefore, even if someone managed to steal the candle from a retail outlet, that person would not be able to use the candle as he/she would not be able to light the wick.

Advantageously, in use, when the body portion is inside the container and locked in the expanded configuration, air can pass from a surface of the candle through the opening such as to allow olfactory interaction of a user with the candle. Thus when the security device is protecting the candle, the user is not prevented from smelling the candle. This is important because the scent of the candle is often one of the selling points.

Advantageously, an edge of the body portion is shaped to substantially conform an inner surface of the container. Having such a shaped body portion means, for example, that any pressure exerted by the body portion on the container would be more evenly distributed than if the body portion only touched the container in one place. Such a shaped body portion also helps to provide a tight fit of the body portion within the container.

Advantageously, the container is a Yankee Candle™ jar.

In accordance with the present invention, there is also described a method of using a security device to protect a product, the security device comprising a body portion operable to be moved between a contracted configuration and an expanded configuration, the product comprising an opening, the method comprising when the body portion is in the contracted configuration, inserting the body portion into the product through the opening; when the body portion is inside the product, moving the body portion from the contracted configuration to the expanded configuration; and when the body portion is inside the product and in the expanded configuration, engaging a locking mechanism of the security device to lock the body portion in the expanded configuration such that the body portion cannot be removed from the product through the opening.

Advantageously, the method includes disengaging the locking mechanism of the security device to unlock the body portion from the expanded configuration so as to move the body portion from the expanded configuration to the contracted configuration whereby the body portion may be removed from the product through the opening.

DETAILED DESCRIPTION

A preferred embodiment of the invention is now provided with reference to the accompanying figures.

Figure 1A:
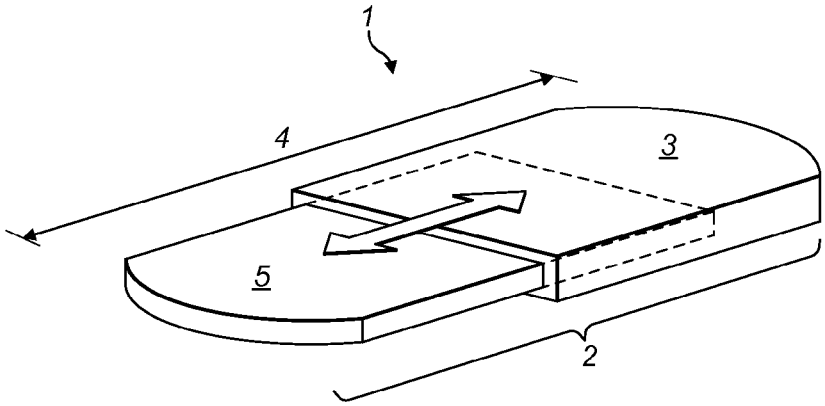
FIG. 1A schematically illustrates a perspective view of one embodiment of the security device of the present invention.

FIG. 1A shows a preferred embodiment of a security device 1 for the protection of a product. The security device comprises a body portion 2 that is moveable between a contracted configuration 2*a*, shown in FIG. 1B and an expanded configuration 2*b*, shown in FIG. 10. The security device 1 may be manufactured from many different materials, such as one or more metals and/or one or more plastics materials.

The body portion 2 comprises a first section 3 and a second section 5. The first and section sections of the body portion are substantially planar. The first section 3 is substantially rectangular with a substantially straight end 34 and a curved end 30. The second section 5 is substantially rectangular with a straight end 36 and a curved end 32. The first section 3 is substantially hollow with an opening at the straight end 34 such that the straight end 36 of the second section 5 can engage with the straight end 34 of the first section 3 such that the second section 5 can slide in and out of the first section 3. Thus planar movement of the first section 3 relative to the second section 5 is possible, where such movement varies the overlap between the first section 3 and second section 5. It is to be understood that there may be alternative means provided such that the first section 3 and the second section 5 are coupled so as to permit planar movement of the first section relative to the second section. The body portion 2 is substantially planar in both the contracted configuration 2*a* and the expanded configuration 2*b*.

Figure 1B:
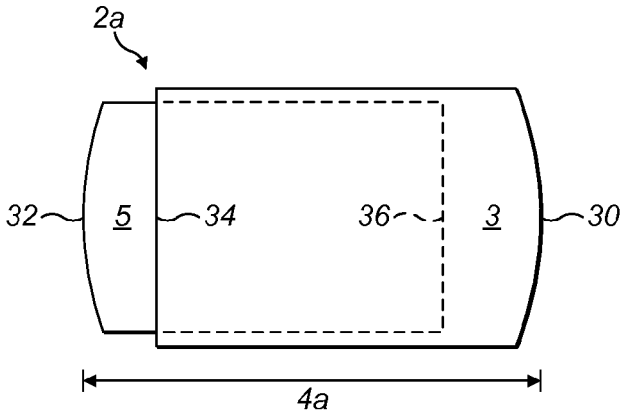
FIG. 1B schematically illustrates a plan view of a contracted configuration of a body portion of the security device of FIG. 1A.
Figure 1C:
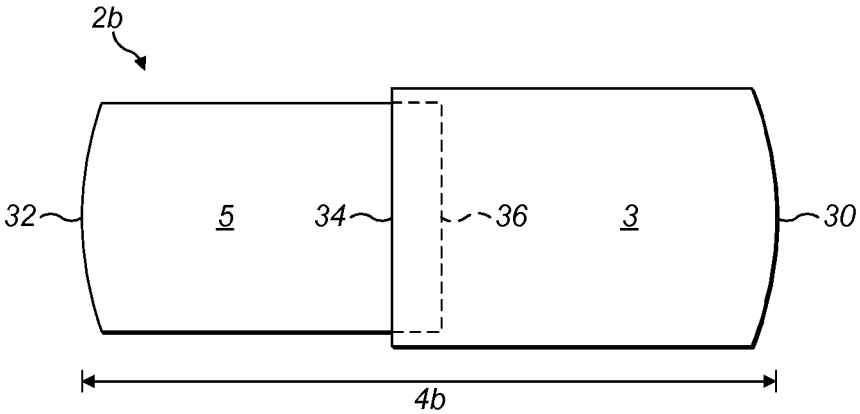
FIG. 1C schematically illustrates a plan view of an expanded configuration of the body portion of the security device of FIG. 1A.

FIG. 1C illustrates schematically an expanded configuration 2*b* of the body portion 2, when the body portion 2 is expanded to its full extent, but it is to be understood there may be additional, intermediate expanded configurations where the first section 3 and second section 5 have an overlap that is smaller than the overlap between the first section 3 and second section 5 in the contracted configuration 2*a*, illustrated schematically by FIG. 1B. As such reference to 'expanded configuration' is understood to mean either the configuration schematically illustrated in FIG. 2C or any of the intermediate configurations.

The body portion 2 has a length 4 between the curved edge 30 of the first section 3 and the curved edge 32 of the second section 5, where the length 4 varies as the first section 3 and the second section 5 move relative to each other. The length 4 may vary between a length 4*a* in the contracted configuration 2*a* and a length 4*b* in the expanded configuration 2*b*. Each expanded configuration 2*b* has a length 4*b* that is greater than the length 4*a* of the contracted configuration 2*a*. Additionally, the body portion 2 has a cross-sectional area that varies as the first section 3 and the second section 5 move relative to each other. Each expanded configuration 2*b* has a cross-sectional area that is greater than a cross-sectional area of the contracted configuration 2*a*.

The movement of the first section 3 relative to the second section 5 may be possible by a mechanism such as a spring loaded mechanism connecting the first and section sections, where the body portion 2 is originally in the contracted configuration 2*a* and a user presses a button to release the spring. Alternatively, the first section 3 and the second section 5 may be moveable by means of actuation by the user either manually or by means of additional actuating means (e.g. a separate device for moving the first and second sections of the body portion 2).

The security device 1 of FIG. 1A also comprises a locking mechanism (shown in FIG. 1D) operable to lock the body portion 2 in the expanded configuration 2*b* and operable to unlock the body portion 2 from the expanded configuration 2*b*. The locking mechanism may be engaged when the body portion 2 is in the expanded configuration 2*b* when the body portion 2 is expanded to its full extent, or may be engaged when the body portion is expanded to an intermediate expanded configuration 2*b*. The locking mechanism may automatically engage as the first section 3 and second section 5 are moved into the expanded configuration by providing a bias to the expanded configuration 2*b*, such as a ratchet mechanism employing a pawl and teeth. Alternatively the locking mechanism may be manually engaged by the pressing of a button by the user.

Figure 1D:
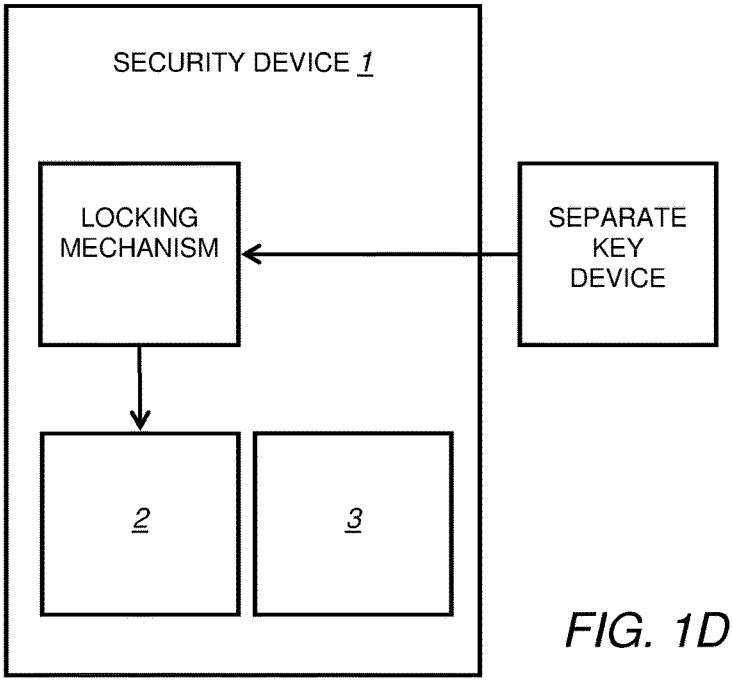
FIG. 1D schematically illustrates the security device of FIG. 1A with a locking mechanism.

As shown in FIG. 1D, an alternative means of engagement may be by use of a separate device such as a key or any other means to lock the locking mechanism. The advantage of having a separate means to lock the locking mechanism is that the locking mechanism would only be lockable by selected individuals and not simply anyone who can access the security device. This would reduce the risk of the device being locked accidentally or inappropriately.

When the body portion 2 of security device 1 of FIG. 1A is locked in the expanded configuration 2*b*, the body portion 2 has a length 4*a* that cannot be reduced below a predefined length. The locking mechanism, when engaged, locks the body portion 2 such that the planar movement of the first section 3 relative to the second section 5 is restricted such that the overlap of the first and second sections cannot be reduced below a predetermined amount, and thus a length 4*b* cannot be reduced below a predefined length, where the predetermined length is a length greater than the length 4*a* of the contracted configuration. This length may correspond to the length 4 of the body portion when the locking mechanism is activated or may be otherwise predetermined. The predetermined length may be set upon engaging the locking mechanism. In an alternative embodiment, when the body portion 2 is locked in the expanded configuration, the length 4*a* of the body portion 2 is substantially fixed. Optionally, when the body portion 2 is locked in the expanded configuration, the cross-sectional area of the body portion 2 cannot be reduced below a predefined area. Furthermore, when the body portion 2 is locked in the expanded configuration, the cross-sectional area of the body portion 2 may be substantially fixed.

In the preferred embodiment of the present invention, the locking mechanism is operable to be disengaged. Thus it is possible to unlock the body portion 2 from the expanded configuration 2*b* by disengaging the locking mechanism. By disengaging the locking mechanism, the body portion 2 becomes moveable from the expanded configuration 2*b* to the contracted configuration 2*a* (and any intermediate configurations in between) as the first section 3 and second section 5 are no longer restricted or prevented from moving relative to each other. Thus the length 4 may vary, including being reduced below the predetermined length. Additionally, the cross-sectional area of the body portion 2 may vary from the cross-sectional area of the body portion 2 in the expanded configuration 2*b* to the cross-sectional area of the body portion 2 in the contracted configuration 2*a* and the cross-sectional areas of the intermediate configurations. Optionally, a separate device may be used to unlock the locking mechanism, which may be different from the separate device used to lock the locking mechanism. For example, the separate device may be a key, or a magnet may be used to lift a gear within the device to release engagement of the gear with teeth inside the device. Having a separate device to unlock the locking mechanism would be advantageous as it would mean that only selected individuals can unlock the locking mechanism and thus increase the security of the product. Furthermore, the individuals tasked with locking the locking mechanism may be different individuals to those individuals tasked with unlocking the locking mechanism. Thus, by providing a separate device to lock the locking mechanism that is different from the device provided to unlock the locking mechanism, the security protection of the product is increased.

Figure 1E:
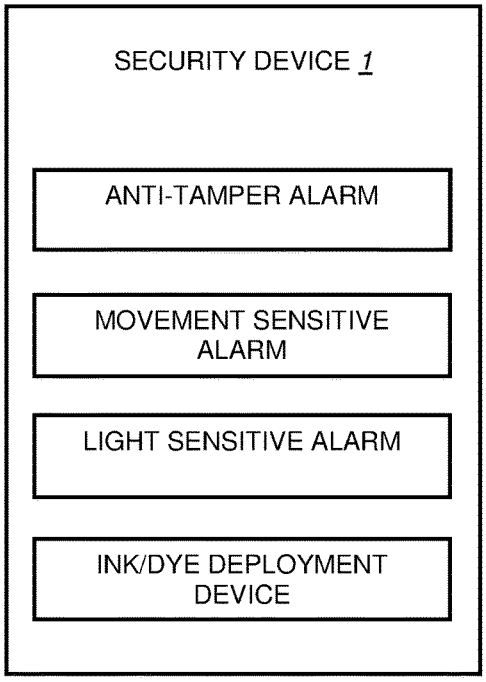
FIG. 1E schematically illustrates the security device of FIG. 1A with different alarms and an ink/dye deployment device.

As shown in FIG. 1E, the security device 1 may comprise additional security features suitable for higher level of protection of a product. For example, the security device may comprise one or more of an Electronic Article Surveillance (EAS) tag suitable for tracking the security device 1, an anti-tamper alarm, a light-sensitive alarm, a movement-sensitive alarm and an ink/dye deployment device.

Figure 2:
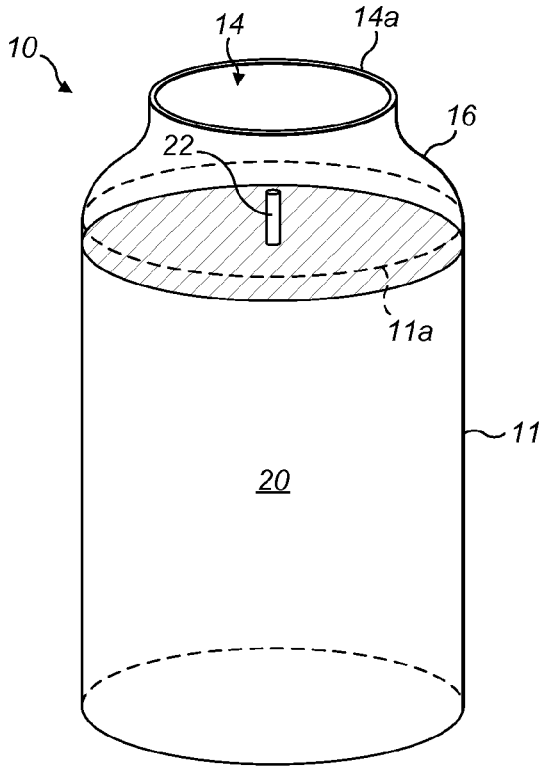
FIG. 2 shows a perspective view of an example of a product which may be protected by the security device of the present invention.

FIG. 2 shows a product 10 that is to be protected by the security device of FIG. 1A, the product comprising an opening 14. In this exemplary embodiment, the product is a container 11 comprising the opening 14, but it is to be understood that other products may be protected by the security device 1. The container 11 is substantially cylindrical with a shoulder 16 where the container size decreases to the opening 14, such that the size of the opening is smaller than the size of the container 11. In the exemplary embodiment of FIG. 2, the circumference 14*a* of the opening 14 is smaller than the circumference 11*a* of the container 11, but it is understood that the relative size of the opening and the container may be otherwise quantified (e.g. length or cross-sectional area). In the embodiment of FIG. 2, the container is a jar containing a candle 20 having a wick 22, however it will be understood that the security device 1 is not limited to use with a candle jar. The wick 22 and the candle 20 are both accessible through the opening 14 (for example the user may touch the candle 20 and the wick 22 through the opening). A passage of air is permitted from the candle 20 through the opening 14 to allow olfactory interaction of a user with the candle. The candle body 20 is dimensioned to substantially fill the container 11 up to below the shoulder 16. In one exemplary embodiment, the product 10 is a Yankee Candle™, and thus the container 11 is a Yankee Candle™ jar.

Figure 3A:
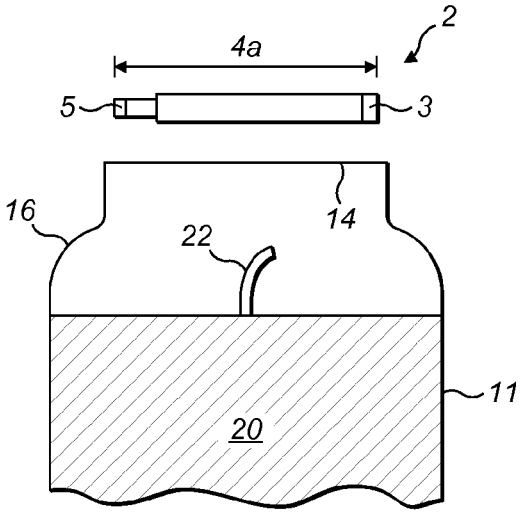
FIG. 3A schematically illustrates a side view of the security device of FIG. 1A and the product of FIG. 2 before insertion of the body portion into the product.

In use, the security device 1 of FIG. 1A may be used to protect the container 11 of FIG. 2. The method of use is such that when the body portion 2 is in the contracted configuration 2*a*, the body portion 2 is inserted into the container 11 through the opening 14. The body portion 2 may already be in the contracted configuration or the user may be required to move the first section 3 and the second section 5 to move the body portion 2 into the contracted configuration. The size of the body portion 2 in the contracted configuration 2*a* is less than a size of the opening 14 such that the when the body portion 2 in the contracted configuration 2*a*, the body portion 2 is insertable through the opening 14*a*, as shown in FIG. 3A. For example, the size of the body portion 2 in the contracted configuration 2*a* may be the length 4*a*, which is less than the diameter of the opening 14, or the size of the body portion 2 in the contracted configuration 2*a* may be its cross-sectional area, which is less than the cross-sectional area of the opening.

Figure 3B:
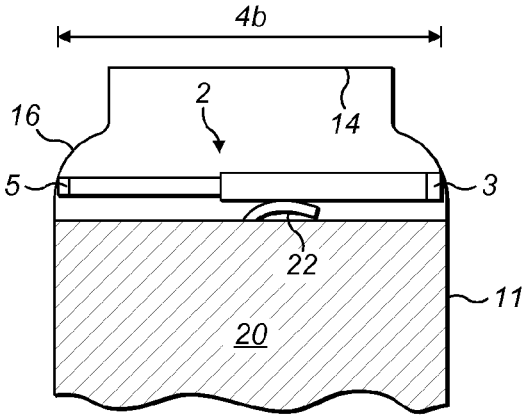
FIG. 3B schematically illustrates a side view of the security device of FIG. 1A and the product of FIG. 2 after insertion of the body portion into the product.
Figure 4:
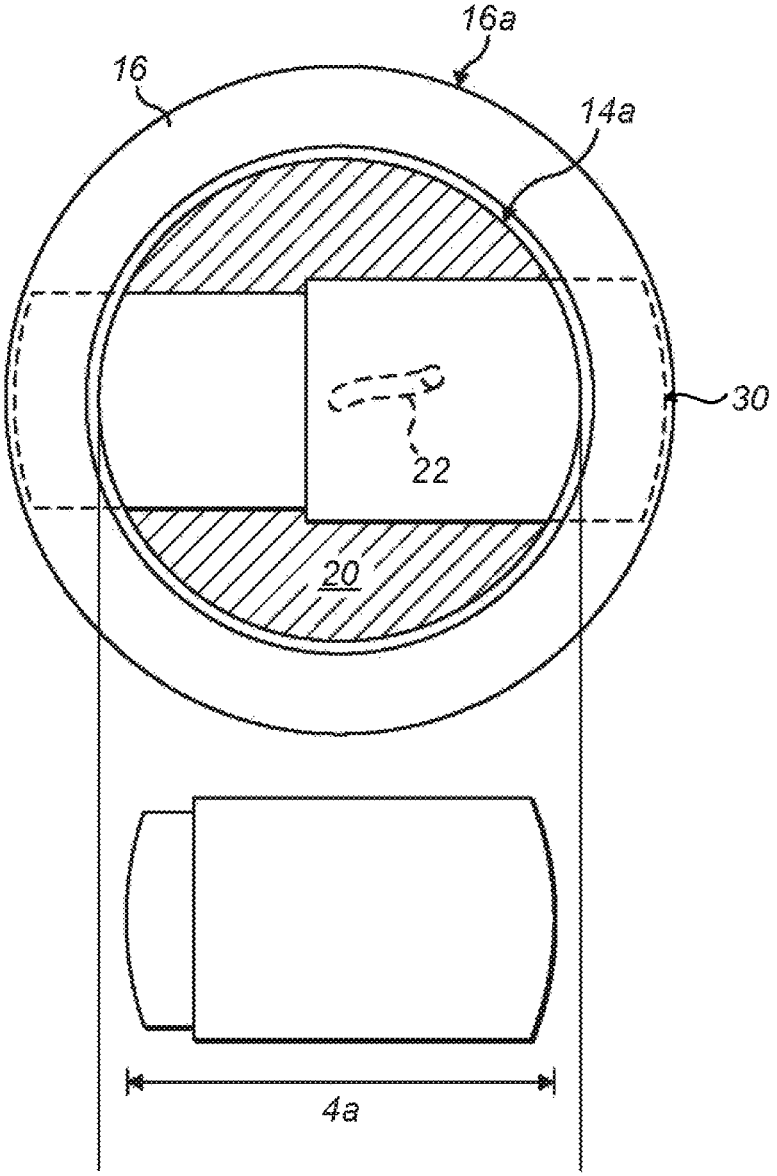
FIG. 4 schematically illustrates a top view of the security device of FIG. 1A and the product of FIG. 2 when the body portion of the security device is in the contracted configuration of FIG. 1B before insertion into the product, and when the body portion of the security device is in the expanded configuration of FIG. 1C after insertion into the product.

The method of use further comprises, when the body portion is inside the product, moving the body portion 2 from the contracted configuration 2*a* to the expanded configuration 2*b*. When inside the container 11, the body portion 2 is arranged at a place inside the container 11 such that the body portion 2 is able to be moved from the contracted configuration 2*a* to the expanded configuration 2*b*, for example, when the body portion 2 is located at a sufficient distance inside the container such as just below the top of the shoulder 16 as illustrated in FIG. 3B; the inside of the container at this point is greater than the size of the opening 14, thus providing space for the body portion 2 to expand. The body portion 2 is moved to an expanded configuration 2*b* that is not necessarily the expanded configuration of FIG. 10, which schematically represents the body portion 2 expanded to its full extent; the body portion 2 may be moved to any of the intermediate expanded configurations, where the body portion 2 in the expanded configuration has a size greater than the size of the opening 14. Additionally, the body portion 2 is moved to the expanded configuration 2*b* such that both the curved edges of the first and second sections are in contact with the container 11 as illustrated in FIGS. 3A, 3B and 4, to minimise movement of the body portion 2 within the container. This would prevent the body portion from moving inside the container when the container is picked up and consequently damaging the container. Preferably, the edge 30 and the edge 32 of the body portion 2 are shaped to substantially conform to an inner surface of the container 11. This has the advantage of providing a greater surface of contact of the body portion 2 with the inner surface of the container 11 to minimise any pressure exerted by the body portion 2 on the container 11.

The method of use further comprises, when the body portion 2 is inside the container 11 and locked in the expanded configuration 2*b*, engaging the locking mechanism to lock the body portion 2 in the expanded configuration 2*b* such that the body portion 2 cannot be removed from the container through the opening. The locking mechanism of the security device 1 is engageable when the body portion 2 is inside the product in the expanded configuration 2*b*. For example, the locking mechanism may be engaged by direct access through the opening 14 or by remote access. By engaging the locking mechanism when the body portion 2 is in the expanded configuration 2*b*, the body portion 2 is locked in the expanded configuration 2*b* and has a size that cannot be reduced below a predefined size. In the preferred embodiment of the present invention, the predefined size is greater than the size of the opening 14 such that the size of the body portion 2 cannot be reduced so as to allow the body portion 2 to be removed from the opening. For example, the size of the body portion 2 in the expanded configuration 2*b* may be the length 4*b*, which is greater than the diameter of the opening 14, or the size of the body portion 2 in the expanded configuration 2*b* may be its cross-sectional area, which is greater than the cross-sectional area of the opening. Thus when the body portion 2 is in the expanded configuration 2*b*, the body portion 2 is not removable through the opening 14. Thus, the body portion 2 is not removable from within the container 11 without breaking the container 11.

In the embodiment of FIGS. 3A, 3B and 4, when the body portion 2 is inside the container and locked in the expanded configuration, the body portion 2 prevents access to the wick 22 through the opening 14. When the body portion 2 is moved from the contracted configuration 2*a* to the expanded configuration 2*b*, it is moved such that the body portion 2 covers the wick 22 so as to be arranged between the wick 22 and the opening 14 such that a user cannot interact with the wick 22 through the opening. In particular, the lighting of the wick 22 is not possible. The size of the body portion 2 in the expanded configuration 2*b* and the arrangement of the body portion 2 inside the container 11 are such that the body portion 2 cannot be moved relative to the wick 22 so as to gain access to the wick 22.

In the embodiment of FIGS. 3A, 3B and 4, when the body portion 2 is inside the container 11 and locked in the expanded configuration 2*b*, air can pass from a surface of the candle 20 through the opening such as to allow olfactory interaction of the user with the candle 20. For example, the surface of the candle may remain accessible through a space between the body portion 2 and the inside surface of the container 11 to allow the passage of air such that the user can smell the candle. As shown in FIG. 4, a central strip of the top of candle 20 is covered by the body portion 2, but two side portions of the top of the candle are not covered. Thus the body portion 2 does not cover the entire top surface of the candle 20 and air can pass from the surface of the candle 20 through the opening 14. Alternatively, the body portion 2 may comprise air passages to allow the passage of air.

The security device of FIG. 1A is used such that the entire security device 1 is inserted into the product 10 through the opening 14 to protect the product 10. This has the advantage that a lid of the container 11 may be attached without removing the security device 1 or otherwise negatively affecting security protection. Nevertheless, it is to be understood that there are alternative embodiments of the present invention where one need not insert the entire security device 1 into the product 10, but only a body portion 2 of the security device 1.

In an additional embodiment, the method of use further comprises disengaging the locking mechanism of the security device 1 to unlock the body portion 2 from the expanded configuration 2*b* so as to move the body portion 2 from the expanded configuration 2*b* to the contracted configuration 2*a* whereby the body portion 2 may be removed from the product through the opening. By disengaging the locking mechanism of the security device 1, the body portion 2 is once again moveable between the expanded configuration 2*b* and the contracted configuration and any intermediate expanded configurations. Thus the body portion 2 can be removed from the product 10 without damage to the product 10 or the security device 1. This provides the advantage of allowing the security device 1 to be removed for maintenance or for re-use on another product 10 through a method as detailed above. Thus, the security device 1 is preferably re-useable. Nonetheless, a disposable security device is also envisaged within the scope of the invention, Although preferred embodiments of the invention have been described, it is to be understood that these are by way of example only and that various modifications may be contemplated.

The invention claimed is:

1. A security device for insertion into a container product for protection of the container product, the security device comprising:

a body portion moveable between a contracted configuration and an expanded configuration; and a locking mechanism operable to lock the body portion in the expanded configuration and operable to unlock the body portion from the expanded configuration;

wherein, when the body portion is locked in the expanded configuration, the body portion has a length that cannot be reduced below a predefined length;

when the body portion is in the contracted configuration, the body portion is insertable into the container product through an opening of the container product;

when the body portion is inside the container product, the body portion is able to be moved from the contracted configuration to the expanded configuration; and when the body portion is inside the container product in the expanded configuration, the locking mechanism is engageable to lock the body portion in the expanded configuration such that the body portion cannot be removed from the container product through the opening of the container product.

2. The security device of claim 1, wherein when the body portion is locked in the expanded configuration, the length of the body portion is substantially fixed.

3. The security device of claim 1, wherein when the body portion is locked in the expanded configuration, the body portion has a cross-sectional area that cannot be reduced below a predefined area.

4. The security device of claim 3, wherein when the body portion is locked in the expanded configuration, the body portion has a cross-sectional area that is substantially fixed.

5. The security device of claim 1, wherein the locking mechanism is operable to unlock the body portion from the expanded configuration by application of a separate key device.

6. The security device of claim 1, wherein the security device further comprises one or more of an Electronic Article Surveillance (EAS) tag, an anti-tamper alarm, a light sensitive alarm, a movement sensitive alarm, and an ink or dye deployment device.

7. The security device of claim 1, wherein the body portion is substantially planar in both the contracted configuration and the expanded configuration.

8. The security device of claim 1, wherein the body portion comprises a first section and a second section, the first and second sections being coupled so as to permit planar movement of the first section relative to the second section.

9. A system for security protection, the system comprising the security device of claim 1 and the container product.

10. The system of claim 9, wherein the container product is a jar.

11. The system of claim wherein the container product contains a candle having a wick accessible through the opening.

12. The system of claim 11, wherein, in use, when the body portion is inside the container product and locked in the expanded configuration, the body portion prevents access to the wick through the opening.

13. The system of claim 11, wherein, in use, when the body portion is inside the container product and locked in the expanded configuration, air can pass from a surface of the candle through the opening such as to allow olfactory interaction of a user with the candle.

14. The security device of claim 1, wherein an edge of the body portion is shaped to substantially conform to an inner surface of the container product.

15. The security device of claim 1, wherein when the body portion is inside the container product, the entire security device is inside the container product.

16. A method of using a security device to protect a container product, the security device comprising a body portion operable to be moved between a contracted configuration and an expanded configuration, the container product comprising an opening, the method comprising:

when the body portion is in the contracted configuration, inserting the body portion into the container product through the opening;

when the body portion is inside the container product, moving the body portion from the contracted configuration to the expanded configuration; and when the body portion is inside the container product and in the expanded configuration, engaging a locking mechanism of the security device to lock the body portion in the expanded configuration such that the body portion cannot be removed from the container product through the opening.

17. The method of claim 16, further comprising disengaging the locking mechanism of the security device to unlock the body portion from the expanded configuration so as to move the body portion from the expanded configuration to the contracted configuration whereby the body portion may be removed from the container product through the opening.

* * * * *